United States Patent [19]

Barnes

[11] Patent Number: 4,911,121

[45] Date of Patent: Mar. 27, 1990

[54] ENGINE PROTECTION DEVICE

[76] Inventor: Richard W. Barnes, 301 N. 67th Ave., Hollywood, Fla. 33024

[21] Appl. No.: 302,462

[22] Filed: Jan. 27, 1989

[51] Int. Cl.[4] ..... F02B 77/00

[52] U.S. Cl. ..... 123/198 D; 123/198 DB; 123/41.15; 123/342; 123/385

[58] Field of Search ..... 123/198 D, 198 DB, 359, 123/479, 41.15, 385, 386, 342

[56] References Cited

U.S. PATENT DOCUMENTS 2,936,747 5/1960 Krol ..... 123/198 D
3,203,407 8/1965 Fleischer ..... 123/198 D
4,727,357 3/1988 Freudenschuss et al. ..... 123/198 D
4,729,355 3/1988 Barnes ..... 123/342

*Primary Examiner*—Noah P. Kamen
*Attorney, Agent, or Firm*—Joseph Zallen

[57] ABSTRACT

An engine protection device which has a valve assembly supplying engine oil to an hydraulic cylinder which in turn is attached to the throttle of an internal combustion engine or governor of a stationary engine. If the oil pressure drops below a predetermined level, a sensor in the valve unit will cause the oil to drain from the hydraulic cylinder so as to slow down or stop the operation of the engine. In addition to using the oil of the engine itself, air or gas can also be used.

9 Claims, 4 Drawing Sheets

ENGINE PROTECTION DEVICE

BACKGROUND OF INVENTION

This invention relates to an engine protection device. In particular, it relates to a novel engine protection device which does not require an outside power source such as compressed air, but can operate off the engine itself.

Engine protection devices have been described in prior patents of the applicant, namely U.S. Pat. No. 4,485,781 and U.S. Pat. No. 4,729,355. In U.S. Pat. No. 4,485,781, a fluid or air pressure activated cylinder in series with the engine throttle rod is used to limit or stop the available engine speed, if the engine oil pressure falls to a predetermined level or engine coolant temperature rises above a predetermined level. U.S. Pat. No. 4,729,355 includes an oil pressure regulator having a fluid release system including a reduced pressure feedback system to vary the return pressure to a higher pressure after initial operation at a lower pressure. In both of these patents, either pressurized fluid or a vacuum source is required.

One object of the present invention is to provide an engine protection device which does not require an outside pressure or vacuum source but can be operated from the engine itself.

Other objects and advantages of the invention will be apparent from the descriptions and claims which follow taken together with the appended drawings.

SUMMARY OF INVENTION

The engine protection device of this invention comprises an assembly having at least one valve unit supplying fluid either to a hydraulic cylinder assembly attached to the throttle of an internal combustion engine or to the governor of a stationary engine. Each valve unit includes a valve, as for example, a 3-way spool valve which is plunger actuated and has a spring return and also a sensor to which the valve is responsive.

In one form of the invention, there are three valve units, one connected to the oil pump of the engine which normally passes through except when the oil pressure drops below a predetermined level so that the normally closed plunger opens. When this happens, the oil in the valve, instead of flowing through drains back to the crank case. A second similar valve receives the oil from the first valve, is normally closed, but the spring loaded plunger is actuated when a line connected to the water manifold shows a pressure below a predetermined level so that oil drains back to the crankcase.

A third valve is normally open and connected to the second valve. Its plunger is actuated by a rise in water temperature above a predetermined level so as to cause oil drain back to the crankcase.

The output of the third valve is connected to a cylinder whose piston is linked to the throttle of the engine or to the oil line of an hydraulic governor. The oil functions as an operating fluid to acutate the throttle. In normal operation, where there is no problem with the engine, the oil passes continuously through the valve assembly to the cylinder and is held under pressure or flows through the governor and then back into the crank case. In the event of low oil pressure, the first valve is blocked which causes the flow of oil to be interrupted to the next two valves, and hence triggers the stopping operation of the piston or hydraulic governor.

If water pressure drops, the second valve blocks passage of oil to valve three with a similar result. If water temperature is too high, the third valve operates to trigger the piston or governor so as to slow or stop operation of the engine.

In accordance with this invention, any one of these valves can be used alone or in combination of pairs with one another. With water cooled engines, the combination of water pressure control and oil pressure control is satisfactory, although it is preferred to also have water temperature control. In the case of an air cooled engine, all that would be required is oil pressure control.

In addition to using the oil of the engine itself as the fluid, other fluids can be used, such as air or gas.

SPECIFIC EXAMPLE OF INVENTION

Figure 1:
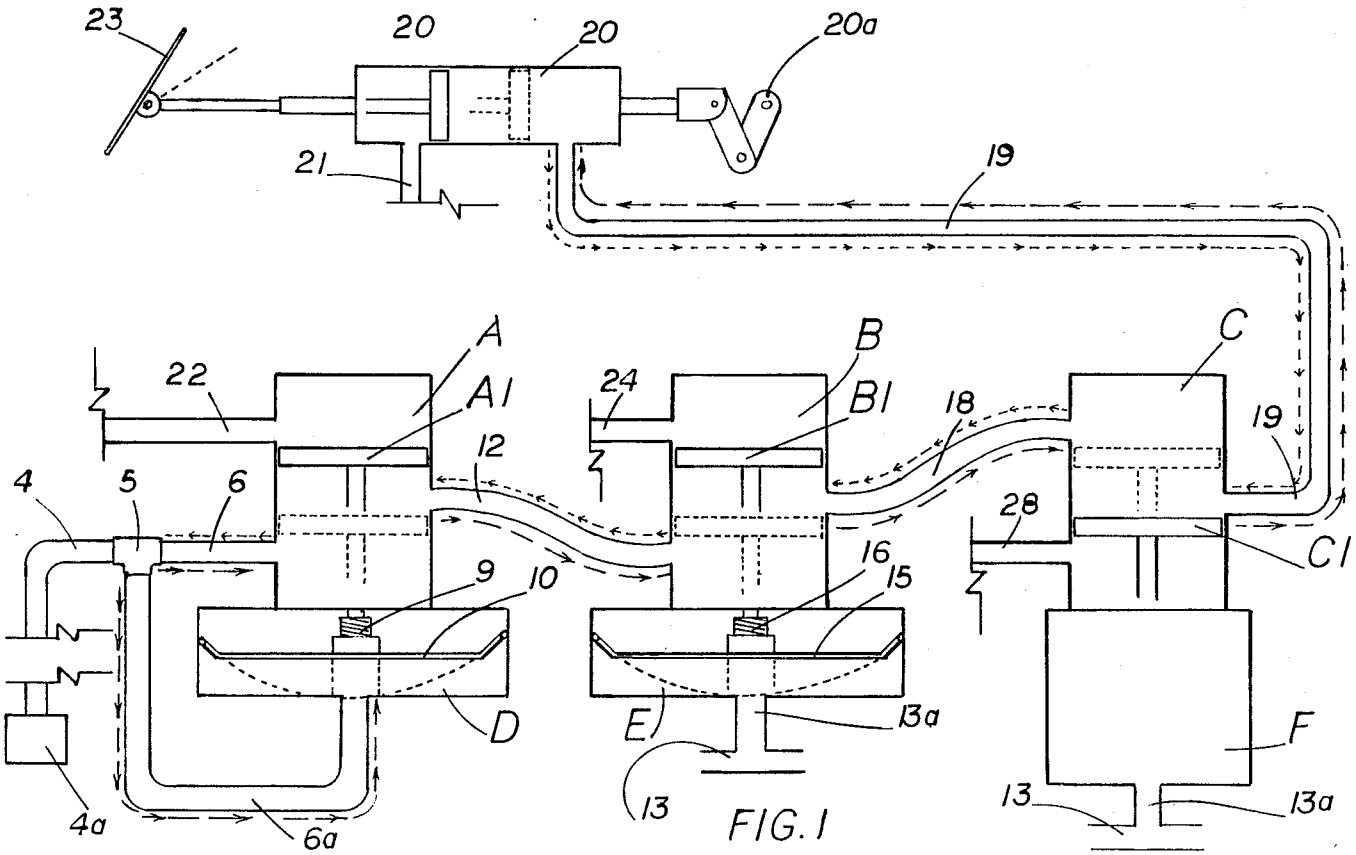
FIG. 1 is a diagrammatic view of one embodiment of this invention as applied to a vehicle engine.

Referring now to FIG. 1, oil flows from the oil pump **4*a* through conduit 4 to T-connection 5 where the flow splits, one portion going to sensor D via conduit 6*a* and the other portion of the flow through conduit 6 into 3-way spool valve A having a spring return and a plunger 10. A commercial example of such a three-way spool valve is Clippard FV3P. Valve A is arranged so that the normal flow through the valve is to conduit 12. However, in the event that the oil pressure sensed by sensor D drops below a predetermined level, the piston A-1 of valve A drops down so as to block conduit 6 and cause the oil to drain back from conduit 12 through exit conduit 22** to the crank case.

When the oil pressure is above the predetermined level, oil flows thorugh conduit 12 to a similar 3-way spool valve B with a spring return and a plunger 15 and a rod 16. Sensor E is responsive to the water pressure in a tap **13*a* off line 13 which is connected to the water manifold. The flow of the oil is normally from conduit 12 to conduit 18. However, where the water pressure in tap 13*a* is below a predetermined level, the spring loaded plunger 16 drops causing piston B1 to close conduit 12 and open conduit 24 so that the oil drains back from conduit 18 through conduit 24** to the crank case.

In the case of normal conditions the oil flows through conduit 18 into 3-way spool valve C having a spring return to conduit 19. However, sensor F coupled with valve C is responsive to the temperature of the water in the water manifold. If the temperature rises above a predetermined level, piston C1 will be actuated causing conduit 19 to be blocked and opening conduit 18 so that the oil drains back from conduit 19 through conduit 28 to the crank case.

Under normal conditions the oil flows into cylinder 20. Conduit 21 is a vent and returns oil to the crank case. However, if the flow through conduit 19 to cylinder 20 is interrupted, the piston and spring associated with cylinder 20 act so as to bring the accelerator down to idling level. Such an accelerator piston arrangement is described and illustrated in U.S. Pat. No. 4,729,355, which patent is incorporated herein by reference.

Figure 2:
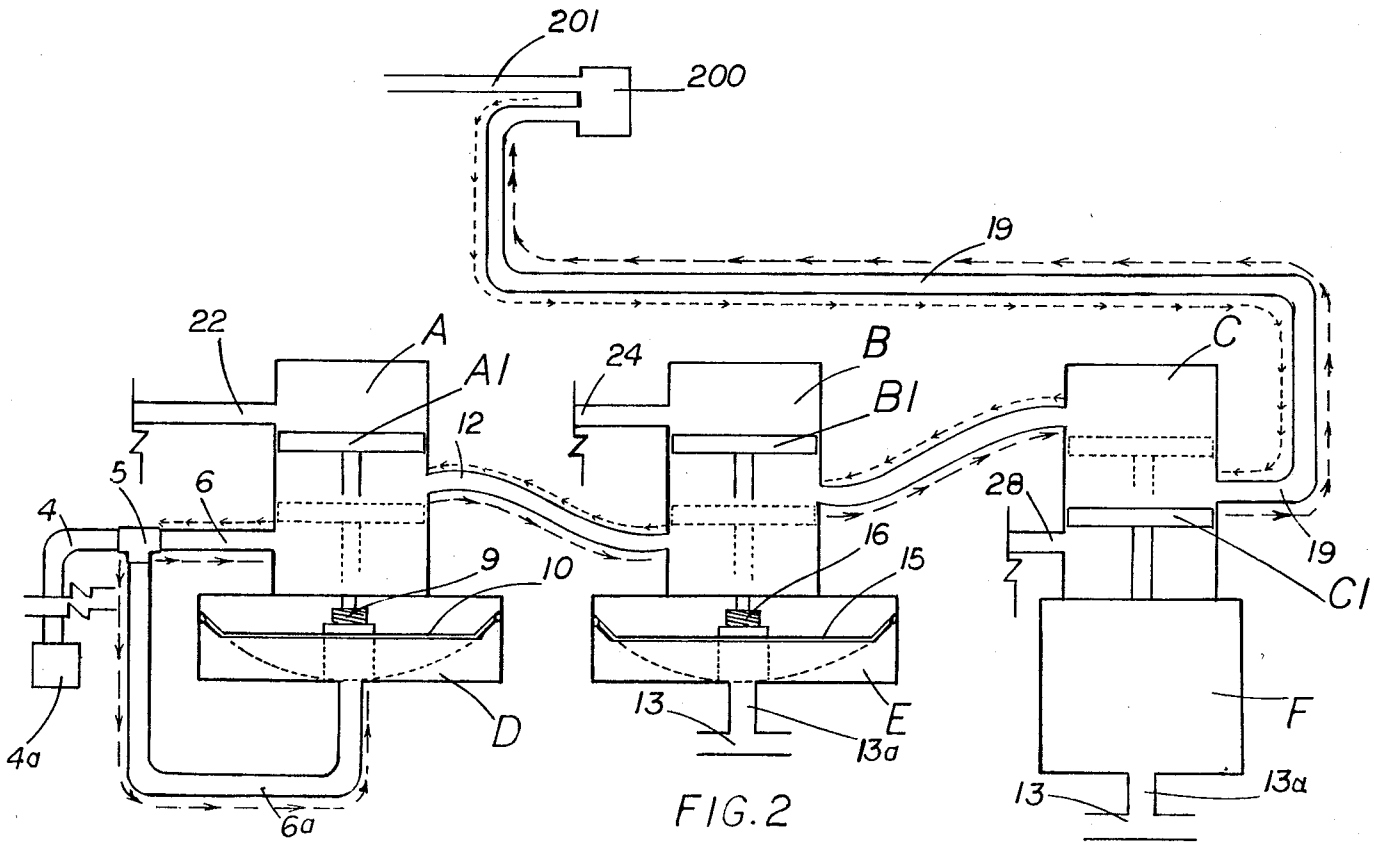
FIG. 2 is a diagrammatic view of another embodiment of this invention as applied to a stationary diesel engine having an hydraulic governor.

The arrangement illustrated in FIG. 2 is similar. Numeral 200 designates an hydraulic governor for a stationary diesel engine. Numeral 201 designates a return line to the crank case. Such a governor typically has a direct line from the oil pump of the engine to the governor. In the present invention the illustrated system 4-A-B-C-19 is substituted for the original direct line. If the oil flow is interrupted by low oil pressure, high water temperature, or low water pressure, the blockage of oil to the governor causes the governor to stop the engine.

Figure 3:
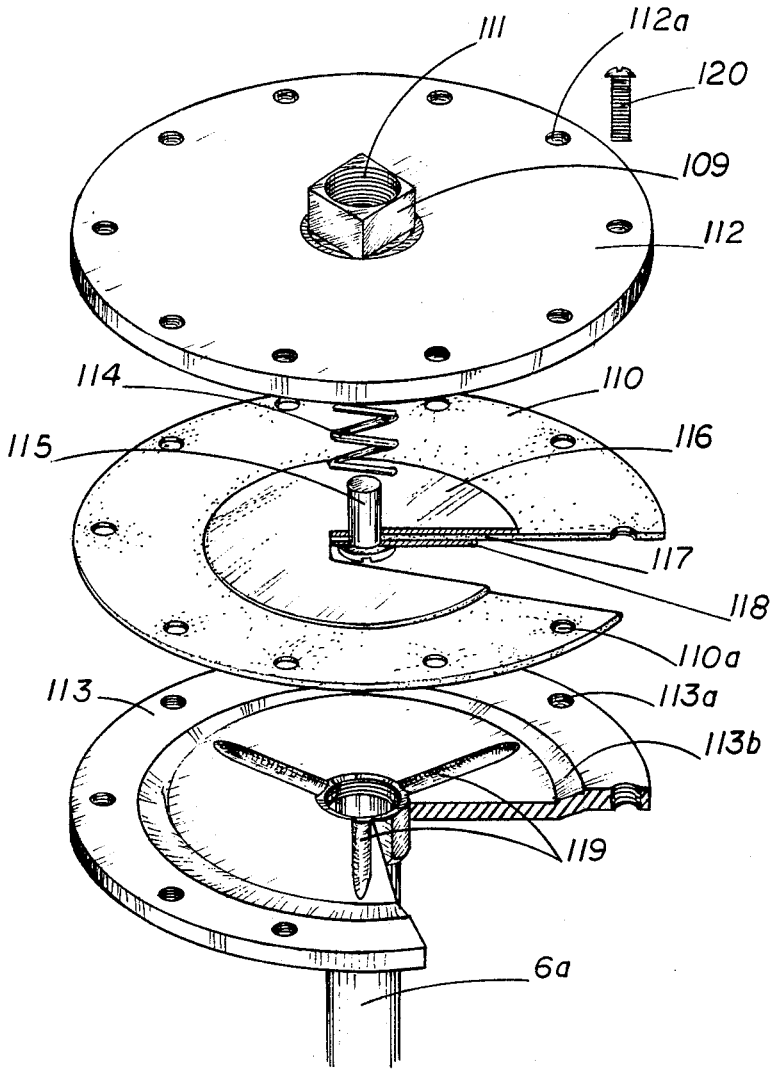
FIG. 3 is an exploded view of the partial cutaway of assembly of FIGS. 1 and 2.

As shown in greater detail in FIG. 3 the piston rod 9 of piston A1 is threaded into threaded opening 111 of nut 109 which is firmly attached to plate 112. Plates 112 and 113 sandwich between them the diaphragm assembly 110 by threaded members 120 on orifices **112*a*, 110*a* and 113*a*. The diaphragm assembly 110 consists of a central washer 116 overlaying the full width rubber layer 117 which rests on a smaller central metal disc 118. Plate 113 has an inner downward bevel 113*b* and troughs 119 to prevent sealing and permit excess fluid to flow out. A guide stem 115 contacts piston rod 9 and is spaced within spring 114**. Calibration for the desired cut-off pressure is done by selecting the proper spring and the proper diameter of the diaphragm, the lower the selected pressure can be.

Figure 4:
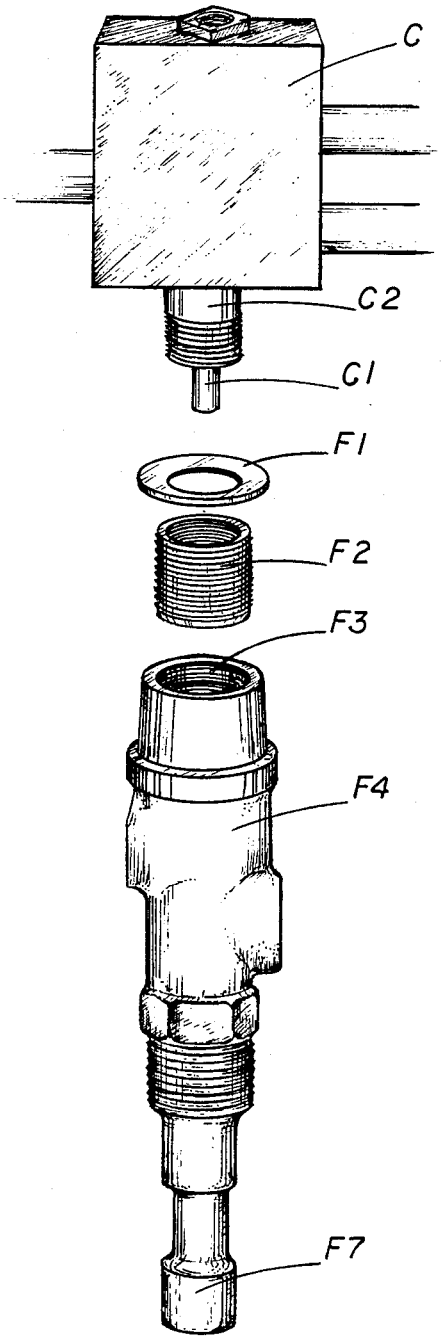
FIG. 4 is an exploded view with partial cutaway of assembly F of FIGS. 1 and 2.

The details of Block F in FIGS. 1 and 2 are better described by reference to FIG. 4. Temperature sensor F7 is attached to a fitting having threaded outlet F4. The sensor and fitting illustrated are adapted from a commercial sensor Kysor 34000. Valve C with its threading C-2 is attached by shim F1 and coupling threading F2 to threading F4. Sensor F-7 contains a vertical plunger (not illustrated) which is engagable with piston rod C-1 when the parts are assembled. Thus, an increase above the desired temperature causes the sensor plunger to rise pushing the piston rod upwardly to the phantom position shown in FIGS. 1 and 2.

I claim:

1. An engine protection device to automatically reduce engine speed to a selected idle or complete stop to prevent damage to the engine from improper engine fluid condition, comprising:

(a) a valve assembly connected to a source of operating fluid under pressure;

(b) engine control means responsive to said operating fluid and connected to the output of said valve assembly and characterized as requiring at least selected pressure of the operating fluid to permit normal operation of the engine but being actuated by a drop in operating fluid pressure below the selected pressure so as to slow or stop the engine; said valve assembly comprising at least one valve means, said valve means having three ports and a piston which is positionable to control said ports, wherein a first port is connected to the output of said source, a second port connected to a drain for said operating fluid, and a third port connected to the engine control means; and (c) first sensor means being attached to said valve means to position said piston, said sensor means having a conduit to said source of operating fluid and a spring biased plunger attached to said piston wherein when said pressure of said source is above a selected pressure the first and third ports are in communication, but when said pressure of said source is below said selected pressure the second and third ports are in communication, whereby the fluid drains from said engine control means when said second and third ports are in communication causing the control means to slow or shut off the engine.

2. The engine protection device of claim 1 wherein said engine control means includes a cylinder whose piston is linked to the throttle of the engine.

3. The engine protection device of claim 1 wherein the engine control means includes a cylinder whose piston is linked to the oil line of an hydraulic governor.

4. The engine protection device of claim 1 wherein said valve assembly includes two said valve means wherein said first valve means has its first port connected to the output of said source, its second port connected to a drain for the fluid, and a third port connected to the first port of said second valve means; the second port of said second valve means being connected to a drain for the fluid, and the third port of said second valve means being connected to the engine control means.

5. The engine protection device of claim 4 wherein a second of said valve means is connected to a second sensor means responsive to engine coolant temperature and positions said piston to allow communication between said second and third ports when said temperature is above a selected temperature.

6. The engine protection device of claim 4 wherein a second of said valve means is connected to a second sensor means responsive to engine coolant pressure and positions said piston to allow communication between said second a third ports when said coolant pressure is below a selected pressure.

7. The engine protection device of claim 1 wherein said valve assembly comprises three said valve means; said first said valve means having its first port connected to the output of said source, its second port connected to a drain for the fluid, and its third port connected to the first port of said second valve means; the second port of said second valve means being connected to a drain for the fluid and its third port being connected to the first port of said third valve means; the second port of said third valve means being connected to a drain for the fluid and its third port being connected to the engine control means.

8. The engine protection device of claim 7 wherein a second of said valve means is connected to a second sensor means responsive to engine coolant temperature and positions said piston to allow communication between said second and third ports when said temperature is above a selected temperature; and where in a third of said valve means is connected to a third sensor means responsive to engine coolant pressure and positions said piston to allow communication between said second a third ports when said coolant pressure is below a selected pressure.

9. The engine protection device of claim 1 wherein said operating fluid is the engine oil and said fluid source is said engine oil under pressure.

* * * * *